US005679507A

United States Patent [19]

Yoshida et al.

[11] Patent Number: 5,679,507

[45] Date of Patent: Oct. 21, 1997

[54] METHOD FOR CHEMICALLY SENSITIZING SILVER HALIDE PHOTOGRAPHIC EMULSION

[75] Inventors: Tetsuya Yoshida; Kazuyoshi Ichikawa; Haruhiko Masutomi; Yusuke Kawahara; Hiroshi Kashiwagi, all of Hino, Japan

[73] Assignee: Konica Corporation, Tokyo, Japan

[21] Appl. No.: 519,695

[22] Filed: Aug. 25, 1995

[30] Foreign Application Priority Data

Sep. 1, 1994 [JP] Japan ..... 6-208666

[51] Int. Cl.[6] ..... G03C 1/09

[52] U.S. Cl. ..... 430/603; 430/569

[58] Field of Search ..... 430/603, 569

[56] References Cited

U.S. PATENT DOCUMENTS

| | | | |
|---|---|---|---|
| 5,217,859 | 6/1993 | Boettcher et al. | 430/569 |
| 5,236,821 | 8/1993 | Yagihara et al. | 430/603 |
| 5,238,807 | 8/1993 | Sasaki et al. | 430/603 |
| 5,242,791 | 9/1993 | Hirano et al. | 430/603 |

FOREIGN PATENT DOCUMENTS

| | | |
|---|---|---|
| 0502531 | 9/1992 | European Pat. Off. . |
| 4-140738 | 5/1992 | Japan . |

*Primary Examiner*—Mark F. Huff

*Attorney, Agent, or Firm*—Frishauf, Holtz, Goodman, Langer & Chick, P.C.

[57] ABSTRACT

A method for chemically sensitizing a silver halide photographic emulsion with a selenium compound is disclosed. The sensitizing method comprises the steps of preparing a dispersion of solid particles of a selenium compound in an aqueous medium by a process comprising the following steps of (1) dissolving a substantially water-insoluble organic selenium compound in a substantially water immiscible low-boiling organic solvent to prepare a selenium compound solution, (2) dispersing the selenium compound solution in water or an aqueous solution of a dispersing aid to form a oil-in-water type dispersion, and (3) removing the organic solvent from the oil-in-water type dispersion by stirring the dispersion under a decompressed condition to precipitate the selenium compound so as to form a dispersion of fine solid particles of the selenium compound having an average particle size of 10 nm to 3 μm;

adding the solid dispersion particles of the selenium compound to a silver halide emulsion, and ripening the silver halide emulsion in the presence of the solid dispersion particles of the selenium compound.

12 Claims, 1 Drawing Sheet

METHOD FOR CHEMICALLY SENSITIZING SILVER HALIDE PHOTOGRAPHIC EMULSION

FIELD OF THE INVENTION

The present invention relates to a method of chemically sensitizing a silver halide photographic emulsion and a silver halide light-sensitive photographic material. The present invention specifically relates to a method of chemically sensitizing a silver halide photographic emulsion having improved photographic properties such as sensitivity and fog, and a silver halide light-sensitive photographic material using a silver halide emulsion sensitized by the sensitizing method.

BACKGROUND OF THE INVENTION

It has been known that a silver halide emulsion to be used in a silver halide photographic light-sensitive material is chemically sensitized by making use of various chemical substances for obtaining a desired sensitivity and gradation thereof. Typical known sensitizing methods include various methods such as a sulfur sensitizing method using a sulfur sensitizer, a selenium sensitizing method, a noble-metal sensitizing method using gold, reduction sensitizing method and that by any combination thereof. Recently in the field of silver halide light-sensitive photographic materials, demands for the improvement of various photographic properties such as enhanced sensitivity, improved image qualities such as granularity and sharpness, and adaptability to rapid processing, whereby development process can be accelerated, became strong.

Among the above-mentioned sensitizing methods, disclosures relating the selenium sensitizing method are given in U.S. Pat. Nos. 1,475,944, 1,602,592, 1,623,499, 3,297,446, 3,297,447, 3,320,069, 3,408,196, 3,408,197, 3,442,653, 3,420,670 and 3,591,385, French Patent Nos. 2,693,038 and 2,039,209, Japanese Patent Examined Publication (JP) Nos. 52-34491/1977, 52-34492/1977, 53-259/1978 and 57-22090/1982, Japanese Patent Publication Open for Public Inspection (JP O.P.I.) Nos. 59-180536/1984, 59-185330/1984, 59-181337/1984, 59-187338/1984, 59-192241/1984, 60-150046/1985, 60-151637/1985, 61-246738/1986, 3-4221/1991, 3-24537/1991, 3-111838/1991, 3-116132/1991, 3-148648/1991, 3-237450/1991, 4-16838/1992, 4-25832/1992, 4-32831/1992, 4-96059/1992, 4-109240/1992, 4-140738/1992, 4-140739/1992, 4-147250/1992, 4-149437/1992, 4-184331/1992, 4-190225/1992, 4-191729/1992 and 4-195035/1992, British Patent Nos. 225,846 and 861984, and "Journal of Photographic Science" 31, p.p. 158–169, H. E. Spencer et al.

It has been known that although the selenium sensitizing method generally shows a larger sensitizing effect than a sulfur sensitizing method usually used in the field of the art, the selenium sensitizing method often shows a tendency to forming a highly fogging and lowering in contrast. Thus most of the above-mentioned publications relate to improvement of such defects. However, these attempts have only lead to unsatisfactory results, and a basic improvement to inhibit fogging is strongly demanded.

On the other hand, JP O.P.I. No. 4-140738/1992 discloses a method in which a selenium sensitizing agent dissolved in an appropriate organic solvent or the selenium sensitizing agent per se in the state of solid or oil is mixed sufficiently with a gelatin solution in advance, and then the gelatin solution containing the selenium sensitizing agent is added to a silver halide emulsion to be sensitized in a form of liquid or solid or jelled. This publication describes that this method is effective to restrain fogging accompanied with selenium sensitization. In the above-mentioned publication, however, there is no disclosure concerning the state of selenium compound in the gelatin solution. Accordingly, a supplying rate of the selenium compound onto the silver halide grains cannot be controlled and satisfactory effects cannot be obtained. As discussed below, it is considerably effective to control the supplying rate of the selenium compound for obtaining a satisfactory sensitizing effect without fogging. Therefore, the method disclosed in JP O.P.I. No.4-140738/1992 is clearly different from that of the invention in which dissolution from the surface of the selenium compound in the form of solid fine particles, or, in other words, supply of the selenium compound on to the silver halide particle is appropriately controlled.

Further, although a considerable increasing in sensitivity can be obtained when gold sensitization is applied with the selenium sensitization or the sulfur sensitization in combination, fog formation is also accelerated at the same time. The fog formation in the selenium-gold sensitization is considerably higher than that in the sulfur-gold sensitization. Accordingly development of technology for inhibiting fog formation in selenium-gold sensitization is strongly expected.

SUMMARY OF THE INVENTION

Referring the above, the first object of the invention is to provide a chemical sensitizing method for high-speed silver halide photographic emulsion and a silver halide photographic light-sensitive material with a reduced fogging. The second object of the invention is to provide a chemical sensitizing method for high-speed silver halide photographic emulsion and a silver halide photographic light-sensitive material being suitable for rapid processing.

The objects of the invention can be achieved by a method for chemically sensitizing a silver halide photographic emulsion comprising the steps of preparing a dispersion of particles of a selenium compound in an aqueous medium by a process comprising the following steps of (1) dissolving an organic selenium compound having a solubility of not more than 0.5 g per 100 g of water at 25° C., in a low-boiling organic solvent having a solubility of not more than 10 g per 100 g of water and a boiling point of not more than 100° C., to prepare a selenium compound solution, (2) dispersing the selenium compound solution in water or an aqueous solution of a dispersing aid to form a oil-in-water type dispersion, and (3) removing said organic solvent from said oil-in-water type dispersion by stirring the dispersion under a decompressed condition to precipitate said selenium compound so as to form a dispersion of fine solid particles of said selenium compound having an average particle size of 10 nm to 3 μm in terms of circular diameter equivalent to projection area thereof;

adding the dispersion of fine solid particles of the selenium compound to a silver halide emulsion, and ripening the silver halide emulsion in the presence of the dispersion of selenium compound particles.

The dispersing operation is preferably performed by the use of a high-speed stirring type dispersing device with a circumference blade speed of not less than 10 m/sec.

DETAILED DESCRIPTION OF THE INVENTION

Figure 1:
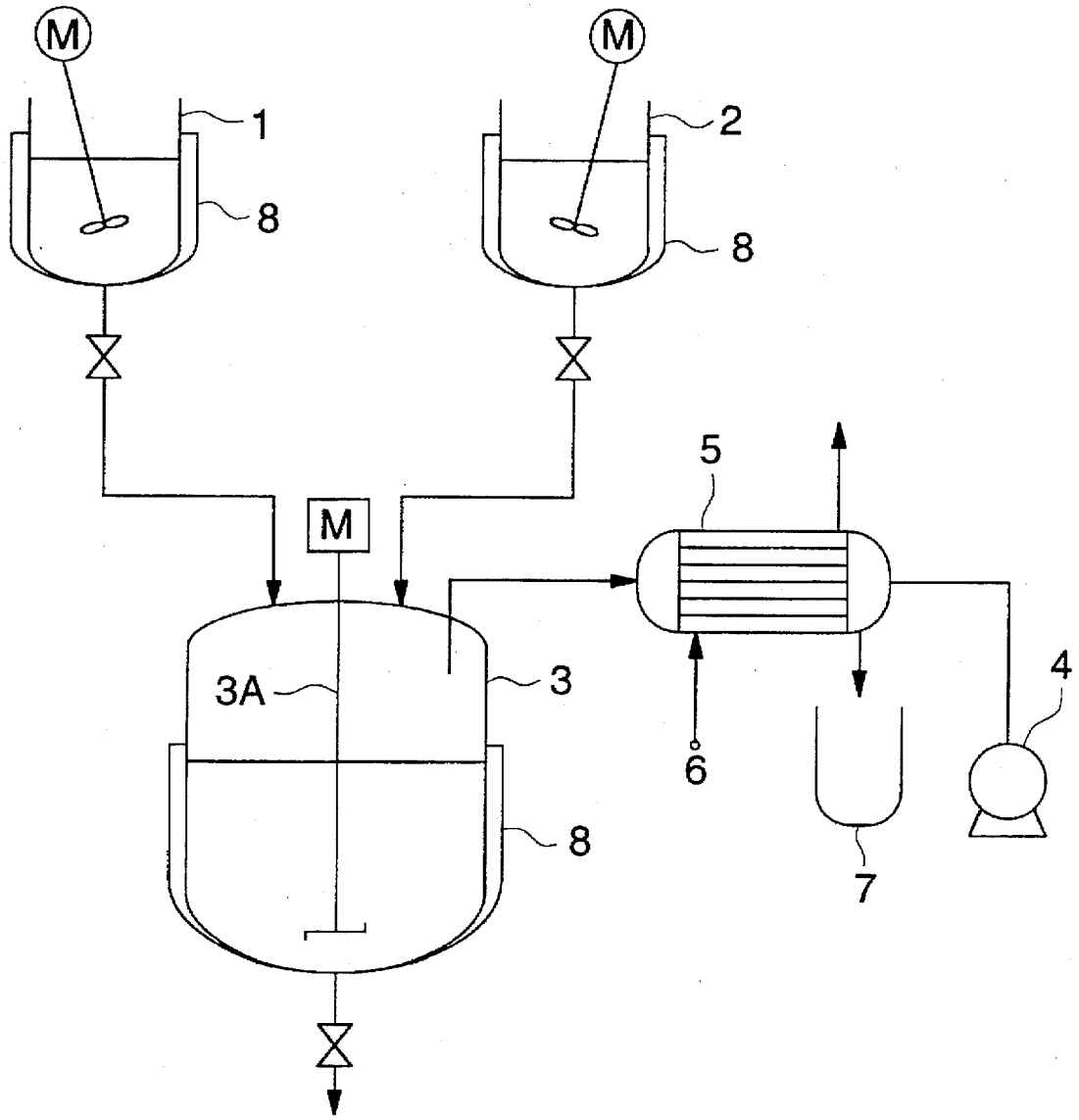
FIG. 1 shows an illustration of an example of installation to be used for the method of the invention.

In the field of the art, a selenium compound is conventionally supplied to a silver halide emulsion by the steps of (1) dissolving it in water or a water-miscible organic solvent, for example, alcohols such as methanol, ethanol or propanol; ethers such as methyl ether; glycols such as ethylene glycol and ketones such as acetone, and, (2) supplying the solution to the silver halide photographic emulsion to perform chemical sensitization. Whereas, the present inventors have found that occurrence of fogging is restrained by supplying the selenium compound to a silver halide photographic emulsion not in the form of solution or in the state of molecule but in the form of a dispersion in which the selenium compound is present as fine solid particles. Also, good results that sensitivity and contrast are enhanced with the above reduction in fogging is obtained often.

The present inventors have assumed that the selenium compound unevenly reacts with the silver halide grains of a photographic emulsion due to extremely quick reaction of the selenium compound with silver halide comparing with the sulfur sensitizer which is conventionally used in the art, when the selenium compound is supplied in the form of solution or in the form of molecule to the silver halide grain. As the result of that, silver halide grains which received excess amount of the selenium compound and ones which received excessively small amount of the selenium compounds are simultaneously formed in the silver halide emulsion. The coexistence of such silver halide grains unevenly reacted with the selenium compound causes remarkable degree of fogging or lowering in gradation and unsatisfactory sensitizing effect.

In the method of the invention, the selenium compound is supplied to the emulsion in the form of solid dispersion particle which have controlled particle diameter or particle surface area. In this case, the selenium compound is successively dissolved out from the surface of each particles thereof with a proper rate and uniformly diffused in the emulsion and reacts with individual silver halide grains. Consequently, the silver halide grains are uniformly sensitized by the selenium compound and required sensitizing effect can be obtained without fogging or lowering in gradation.

Further, according to the invention, it becomes possible to control supplying rate of the selenium compound to the silver halide grains contained in the silver halide photographic emulsion. This means that uniform supply of the selenium compound onto the individual silver halide grains may be ensured by sufficiently retarding the dissolution rate of the selenium compound against the average mixing time of the silver halide emulsion which is under agitation.

Further, since the selenium compound in the form of solid dispersion particle is used for controlling the supplying rate of the selenium compound onto the silver halide grains by making use of its dissolving rate after being added to the silver halide emulsion, the specific surface area of the selenium compound particle, or variation of the particle diameter causes variation of the supplying rate onto the silver halide grains. Accordingly, the variation of the particle size due to standing of the selenium compound in the dispersion prepared in accordance with the present invention is required to be extremely small. Further, it is required that standing stability of the selenium compound particles in the dispersion or, more specifically, precipitation of the particles does not takes place because a prescribed amount of selenium compound should be exactly supplied to the emulsion.

General concept of the invention is described referring to an example of manufacturing installation illustrated in FIG. 1.

A substantially water-insoluble selenium compound is dissolved in a substantially water-immiscible low-boiling organic solvent in a dissolving vessel 1 to prepare an organic solvent solution of selenium compound, Solution 1. On the other hand, water or a water solution of a surfactant and/or a binder, Solution 2, is prepared in a dissolving vessel 2. Solutions 1 and 2 thus obtained are emulsified in a dispersing vessel 3 having a high-speed stirring type dispersing device 3A to form a oil-in-water type dispersion. Then the pressure in the dispersion vessel 3 is reduced and the dispersion is stirred by the high-speed stirring type dispersing device 3A for evaporating the substantially water-immiscible low-boiling organic solvent and precipitating the selenium compound. Thus, a solid-in-liquid type dispersion containing stable fine solid dispersion particles of the selenium compound is prepared. The evaporated solvent is cooled and converted to a liquid in a heat exchanger 5 by cooling medium 6 and recovered in a recovering tank 7.

In the above-mentioned installation, the dissolving vessels 1, 2 and the dispersing vessel 3 each may have a heating jacket 8, in which warm water flows, or a heater to control the temperature of the dispersion for accelerating and stabilizing the dissolution and dispersion process. As the high-speed stirring dispersing device, a proper one can be optionally selected from the various types such as a dissolver type, paddle type, propeller type or homomixer type, each having a dispersing blade. The temperature in the dispersing vessel 3 is preferably maintained within the range of 10° to 80° C.

It also be allowed to supply the solutions 1 and 2 in a form of a mixture to the dispersing vessel 3 or in a manner different from the above-mentioned in which the solution 1 and the solution 2 are separately supplied to the dispersion vessel 3. Although, in usual, the high-speed stirring dispersing device 3A is driven after the solutions 1 and 2 are supplied to the dispersing vessel 3, the dispersion can be performed by gradually supplying the solutions 1 and 2 to the vessel 3 while driving the dispersing device 3A. In FIG. 1, M is a motor.

Stirring conditions in the above emulsifying dispersion process are important parameters for controlling the diameter of fine solid dispersion particle of selenium compound after precipitation thereof. Particularly, the diameter of fine solid dispersion particle of selenium compound is changed depending on the rotating speed of the high-speed stirring type dispersing device 3A, the time of dispersing operation, and compositions of Solutions 1 and 2. The circumference speed of dispersing blade of the high-speed stirring type dispersing device is preferably not less than 10 m/sec. and within the range in which any problem causing undesirable effect on the dispersion, such as considerable foaming caused by cavitation, does not raised. The circumference speed of dispersing blade of the high-speed stirring type dispersing device is preferably within the range of 10 m/sec. to 50 m/sec. When the circumference blade speed of the dispersing device is lower than 10 m/sec, diameter of the droplet in the oil-in-water type dispersion formed in the dispersing process can hardly be made satisfactorily small. As the result of that, the size of precipitated particle after the pressure reduction process is made too large and preparation of a stable dispersion becomes to be difficult.

The circumference blade speed of the dispersing device in the emulsifying dispersion process may be the same or different to that in the process of removing the water immiscible low-boiling organic solvent. It is preferable that the stirring under the reduced pressure is started immediately after the completion of formation of the oil-in-water type dispersion in the emulsifying dispersion process. Such operation is performed to prevent aggregation and association of the oil droplets in the oil-in-water type dispersion during the standing period between completion of the dispersing process and start of the process of stirring under the reduced pressure.

The time for emulsifying dispersion is preferably 3 to 180 minutes, though it depends on the diameter of solid dispersion particles to be obtained and the compositions of the solutions 1 and 2. In the process of pressure reduction for removing the water-immiscible low-boiling organic solvent, the pressure is reduced gradually to approximately 100 Torr, which may be different depending on the kind of the water-immiscible low-boiling organic solvent. The operation can be preferably performed according to the methods disclosed in JP O.P.I. Nos. 2-83029/1990 and 2-90937/1990.

The liquid temperature at the time for removing the water-immiscible low-boiling organic solvent is preferably 40° to 80° C., particularly 50° to 70° C. The removing of the water-immiscible low-boiling organic solvent is preferably carried out until a remaining amount of the solvent becomes 1 weight % or less for decreasing the amount of dissolved selenium compound molecules, and for preventing formation of coating defects caused by a high content of the organic solvent in the silver halide emulsion to be coated.

As the substantially water-immiscible low-boiling organic solvent usable in the present invention, one having a solubility in water of not more than 10 g per 100 g of water and a boiling point not more than 100° C., particularly not more than 85° C., is preferable. Concrete examples of such solvent include, ethyl acetate, n-hexane, n-pentane, benzene, cyclohexane, cyclopentane, chloroform and dichloromethane.

As the dispersing aid, a surfactant, a binder and a mixture of them are usable, which are effective for preventing aggregation of droplets in the oil-in-water type dispersion in the dispersing process or precipitated fine solid particles in or after the precipitation process, and enhancing stability the droplets or the particles. The dispersing aids may also be contained in the water-immiscible low-boiling organic solvent, if necessary, which is the oil phase of the dispersion.

The above-mentioned surfactant includes, for example, nonionic surfactants such as saponine (steroid type); alkylene oxide derivatives such as polyethylene glycol, condensation compounds of polyethylene glycol and polypropylene glycol, alkyl ethers of polyethylene glycol, alkylaryl ethers of polyethylene glycol, polyethylene glycol esters, polyethylene glycol sorbitan esters, polyethylene glycol alkylamines, polyethylene glycol amides and additional adducts of polyethylene glycol with silicone, glycidol derivatives such as alkenylsuccinic polyglyceride and alkylphenol polyglyceride, fatty acid esters of polyhydric alcohol; alkyl esters of sugars, urethanes and ethers; anionic surfactants each having an acidic group such as carboxy group, a sulfo group, sulfate group or phosphate group, which include triterpenoid type saponine, alkylcarboxylic acid salts, lakylsulfonic acid salts, alkylbenzenesulfonic acid salts, alkylnaphthalenesulfonic acid salts, alkyl sulfates, alkyl phosphonates and sulfoalkylpolyoxyethylene alkylphenyl ethers; an amphoteric surfactants such as amines, aminoalkylsulfonic acid salts, aminoalkyl sulfates, aminoalkyl phosphates, alkylbetaines, amineimides and amine oxides; and cationic surfactants such as alkylamine salts, tertiary ammonium salts of fatty acid or aromatic acid, heterocyclic tertiary ammonium salts such as pirydinium or imidazolium salt and phosphonium or sulfonium salts having an aliphatic group or a heterocyclic group. Among them, anion surfactants such as sodium dodecylbenzenesulfonate, sodium dodecylsulfate and "Aerosol A102" (product of Cyanamid Co.) are preferably used.

The preferable amount of surfactant is usually 0.1 to 100 times of the lowest micelle-forming concentration thereof, which may be changed depending on the kind of substantially water-immiscible low-boiling organic solvent, the kind of binder, the kind and amount of selenium compound used. The lowest micelle-forming concentration of the surfactant is commonly within the range of $10^{-4}$ to 1 mol/l, although that is varied depending on the structure of surfactant.

As the above-mentioned binder, water-soluble binders are preferably used, which include, for example, proteins such as gelatin, gelatin derivatives, graft polymers of gelatin and high molecular weight compound, albumin and casein; cellulose derivatives such as hydroxyethyl-cellulose, carboxymethylcellulose and cellulose sulfate; sodium arginate, sugar derivatives such as starch derivatives; and various kinds of synthetic hydrophilic high molecular weight compounds including homopolymer or copolymers such as polyvinyl alcohol, partially acetalized polyvinyl alcohol, poly-N-vinylpyrrolidone, polyacrylic acid, polymethacrylic acid, polyacrylamide, polyvinyl-imidazole and polyvinylpyrazole. Usually, gelatin is preferably used. As gelatin, lime-processed gelatin is usually used. However, acid-processed gelatin, enzyme-processed gelatin described in "Bull. Soc. Sci. Phot. Japan" No. 16, p. 30, 1966, and hydrolyzed gelatin can also be used.

In the case of using the above binder, it is preferable that the concentration of the binder in the solution prepared in the dispersing vessel 3 to make to 3 to 45% by weight, which may be changed depending on the kind of gelatin, and the kind and the amount of the water-insoluble selenium compound used.

Compound substantially water-insoluble selenium compound usable in the invention include those disclosed in the above-mentioned patents publication, for example, selenoureas such as N,N-dimethylselenourea, N,N,N'-triethylselenourea, N,N,N'-trimethyl-N'-heptafluoropropylcarbonylseleno-urea, N,N,N'-trimethyl-N'-nitrophenylcarbonylselenourea; selenophosphates such as tri-p-triselenophosphate; selenides such as diethyl selenide, diethyl diselenide, pentafluorocyclohexyldiphenylphosphine selenide and triphenylphosphine selenide. Among them, triphenyl-phosphine selenide is preferable. In the present invention, the term of "substantially water-insoluble selenium compound" denotes a organic compound containing a selenium atom in the molecule thereof which has a water solubility of not more than 0.5 g per 100 g, preferably not more than 0.1 g, per 100 g of water at 25° C.

The solubility of the above-mentioned low-boiling solvents and selenium compounds can be measured by a method described in "Shin Jikken Kagaku Kooza 1" (New Course of Experimental Chemistry, Vol. 1) p.p. 245–250, Maruzen Co. Tokyo, 1975.

In the present invention, the term of "circular diameter equivalent to projection area" denotes a diameter of a circle having a area the same as the projection area of a precipitated particle or solid dispersion particle of selenium compound, hereinafter referred simply as diameter of solid particle. When such diameter of the solid dispersion particle of the selenium compound exceeds 3 μm, sedimentation of the particles is occurred, which causes a undesirable effect on the uniformity of the dispersion. On the other hand, when the diameter is less than 10 nm, the dissolving rate of the particles in a silver halide photographic emulsion is accelerated by increasing in the surface area of the particle. As the result of that, the ingredient of the solid dispersion particles cannot be uniformly supplied on each of silver halide grains. Therefore, the diameter of the solid dispersion particle of the selenium compound is preferably within the range of 10 nm to 3 μm in the invention. Accordingly, the diameter of droplet of the selenium compounds solution in the oil-in-water dispersion before solvent removing process is controlled so that the diameter of solid dispersion particles of the selenium compound to be fallen within the range of 10 to 3 μm after removing the solvent. The diameter of the droplet can be controlled within the range of 10 to 5 μm by controlling the above-mentioned parameters such as the amount of surfactant, the kind and amount of the substantially water-immiscible low-boiling solvent, the kind and amount of the binder and the kind and amount of the substantially water-insoluble selenium compound.

The amount of the selenium compound to be used in the selenium sensitization of the invention is usually $10^{-8}$ to $10^{-4}$ moles, preferably $10^{-7}$ to $10^{-5}$ moles, per mol of silver halide contained in the emulsion to be sensitized, even though it may be changed depending on the kind of selenium compound, the kind of silver halide grains and the chemical ripening conditions.

Although there is no specific limitation on the conditions of the chemical sensitization according to the invention, pAg is 6 to 11, preferably 7 to 10, more preferably 7 to 9.5, and the temperature is 40° C. to 95° C., preferably 50° C. to 80° C.

In the present invention, it is preferable to use a noble metal sensitizer such as gold, platinum, paradigm or iridium together with the selenium compound. It is particularly preferable to use a gold sensitizer such as chloroauric acid, potassium chloroaurate, potassium aurothiocyanate, gold sulfide or gold selenide, which may be used in an amount of approximately $10^{-7}$ to $10^{-12}$ moles per mol of silver halide.

In the invention, it is also preferable to use a sulfur sensitizer together with the selenium compound. As concrete sulfur sensitizers, well known labile sulfur compounds may be used, which include, for example, thiosulfates such as sodium thiosulfate, thioureas such as diphenylthiourea, triethylthiourea and arylthiourea and rhodanines. These sulfur sensitizer may be used in an amount of about $10^{-7}$ to $10^{-2}$ moles per mol of silver.

When a gold sensitizer is used together with the selenium compound in the invention, gold-sulfur-selenium sensitization is more preferably applied, in which a sulfur sensitizer is used together with a gold compound and a selenium compound.

In the invention, it is further possible to apply a reduction sensitizer together with the above-mentioned sensitizers. Reduction sensitizers usable for the reduction sensitization include stannous chloride, aminoiminomethanesulfinic acid, hydrazine derivatives, borane compounds and polyamine compounds.

In the invention, the gold sensitizers, the sulfur sensitizers and the reduction sensitizers may be each supplied to a silver halide photographic emulsion in a form of solution in water or in an appropriate organic solvent, in a form of dispersion prepared in the similar manner applied for selenium compound of the invention, or in a form of dispersion or suspension which prepared by dispersing or mixing by a high-speed stirring type dispersing device in the absence of organic solvent. Further, these sensitizer may be supplied in combination with the solid dispersion particles of selenium compound prepared by the invention. The sensitizer other than the selenium compound may be supplied before, after or at the same time of supplying the solid dispersed particles of selenium compound when the sensitizer is separately supplied from the selenium compound.

A silver halide solvent may be supplied to the silver halide emulsion separately or together with the above noble metal sensitizer, sulfur sensitizer or reduction sensitizer. The silver halide solvent may be supplied in any form. It is preferable to perform the selenium sensitization of the invention in the presence of the silver halide solvent.

In the concrete, the silver halide solvent includes thiocyanates such as potassium thiocyanate, thioether compounds such as those described, for example, in U.S. Pat. Nos. 3,021,157, 3,271,157, JP No. 58-30571/1983 and JP O.P.I. No. 60-136736/1985, particularly 3,6-dithia-1,8-octanediol, thiourea compounds having four substituents such as those described, for example, in JP No. 59-11892/1984, U.S. Pat. No. 4,221,863, particularly tetramethylthiourea, thione compounds described in JP 60-11341/1985, mercapto compounds described in JP 63-29727/1988, mesoionic compounds described in JP O.P.I. 60-163042/1985, and selenoether compounds described in U.S. Pat. No. 4,72,013 and JP O.P.I. No. 2-132434/1990. Among them, thiocyanates, thioethers, thiourea compounds having four substituents, and thione compounds are preferable, and thiocyanates are particularly preferable. The silver halide solvent may be used in an amount of about $10^{-5}$ to $10^{-2}$ moles per mole of silver halide contained in the emulsion to be sensitized.

The silver halide photographic emulsion usable in the invention and a light-sensitive material using it will be described in detail below.

Silver halide preferably usable in the photographic emulsion according to the invention include silver bromide, silver iodobromide, silver iodochlorobromide, silver chlorobromide and silver chloride.

Silver halide grains to be sensitized by the method of the invention include those having a regular crystal form such as cubic or octahedral shape, those having an irregular crystal form such as sphere or tabular shape, and those having complex of these crystal form. Although a mixture of grains having various crystal forms may be used, particles having regular crystal form are preferable.

Silver halide grains usable in the invention may have the same or different phases in the inner portion and the surface portion thereof. The silver halide grains may be either ones in which latent images are formed mainly on the surface thereof such as those of a negative type emulsion or ones in which latent images are formed mainly in the internal portion thereof such as those of an internal image forming emulsion or those of a prefogged type direct reversal emulsion. The grains in each of which latent images are formed mainly on the surface are preferable.

In the invention, a tabular grain silver halide photographic emulsion is preferably used, in which sum of projection area of tabular grains having a thickness of not more than 0.5 μm, preferably not more than 0.3 μm, and a size of not more than 0.6 μm, and an average aspect ratio of not less than 3, occupies 50% or more of the total projection area of the whole silver halide grains contained in the emulsion. A monodispersed silver halide emulsion is also preferably used in the invention which have a statistical variation coefficient of grain size distribution of not more than 20%. The variation coefficient is a value of S/div. in which S is a standard deviation of grin diameter distribution and "div." is an average grain diameter, the grain diameter is referred in terms of diameter of a circle equivalent to the projection area of the grain. A mixture of two or more kinds of emulsions including a tabular grain emulsion and a monodispersed emulsion also may be used. The above-mentioned aspect ratio is an average of the values obtained by dividing the circle equivalent diameter of main plane of a tabular by the thickness for individual grains of a silver halide emulsion.

A silver halide emulsion to be used in the invention may be prepared by the method described, for example, in P. Grafkides, "Chimie et Physique photographique", Poul Montel, 1967; G. F. Duffin, "Photographic Emulsion Chemistry", Focal Press, 1966; and V. L. Zelikman et al. "Making and Costing Photographic Emulsion", Focal Press, 1964.

A light-sensitive material of the invention contains at least one emulsion layer comprising a kind of silver halide photographic emulsion sensitized by the above-mentioned chemical sensitizing method of the invention.

As a binder or a protective colloid usable in an emulsion layer or an intermediate layer of the light-sensitive material of the invention, gelatin is suitably used. However, hydrophilic colloids other than gelatin may be used, which include, for example, gelatin derivatives, graft polymers of gelatin and high molecule substances other than gelatin, proteins such as albumin and casein, cellulose derivatives such as hydroxyethyl cellulose, carboxymethyl cellulose and cellulose sulfate, sugar derivatives such as sodium arginate and starch derivatives, and various kinds of synthetic hydrophilic high molecular weight compounds including homopolymer or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

Besides usual lime-processed gelatin, acid-processed gelatin, enzyme-processed gelatin described in "Bull. Soc. Sci. Phot. Japan" No. 16, p. 30, 1966, and hydrolyzed gelatin are also may be used In a light-sensitive material of the invention, an inorganic or organic hardener may be contained in any hydrophilic colloid layer constituting a photographic light-sensitive layer or a backing layer. In the concrete, for example, chromium salts, aldehydes such as formaldehyde, glyoxal and glutalaldehyde, N-methylol compounds such as dimethylolurea are cited. Reactive halogen compounds such as 2.4-dichloro-6-hydroxy-1,3.5-triazine and its sodium salt, and reactive vinyl compounds such as 1,3-bis-vinylsulfonyl-2-propanole, 1,2-bis(vinyl-sulfonylacetoamide)ethane, bis (vinlsulfonylmethyl)ether and vinyl polymers each having a bisulfonyl group at a side chain thereof, are preferable because they can rapidly hard the hydrophilic colloid such as gelatin while giving stable photographic properties. N-carbamoylpyridinium salts such as (1-morpholinocarbonyl-3-pyridino)methanesulfonate, and haloamidium salts such as 1-chloro-1-pyridinomethylene-pyrrolydinium 2-naphthalenesulfonate, are also excellent in a high hardening rate.

The silver halide photographic emulsion according to the invention may be spectrally sensitized with a sensitizing dye such as a methine dye. Dyes usable for the spectral sensitization include cyanine dyes, merocyanine dyes, complex cyanine dyes, complex merocyanine dyes, holopolar cyanine dyes, hemicyanine dyes, styryl dyes and hemioxonol dyes. Particularly suitable dyes are cyanine dyes, merocyanine dyes, and complex merocyanine dyes. As basic heterocyclic nuclei of these dyes, those usually used in cyanine type dyes are all applicable. The nuclei include nucleus of pyrroline, oxazoline, thiazoline, pyrrole, oxazole, thiazole, selenazole, imidazole, tetrazole and pyridine; and condensation nuclei of the above-mentioned nuclei with alicylic hydrocarbon ring such as nucleus of indolenine, benzoindolenine, indole, benzoxazole, naphthoxazole, benzothiazole, naphthothiazole, benzoselenazole, benzomidazole and quinoline. These nuclei may each have a substituent on a carbon atom thereof.

To the merocyanine dyes and complex merocyanine dyes, five- or six-member heterocyclic nuclei such as nucleus of pyrazoline-5-one, thiohydantoin, 2-thioxazolidine-2,4-dione, rhodanine and thiobarbituric acid may be applied as nuclei each having ketomethylene structure.

These sensitizing dyes may be used singly or in combination. Combination of dyes are frequently used for the purpose of super-sensitization. A substance having a super-sensitizing effects such as a dye having no spectral sensitizing effect or a compound which substantially does not absorb any visible light may be used in the emulsion. Such substances include aminostilbene compounds each substituted with a nitrogen-containing heterocyclic ring such as those described in U.S. Pat. Nos. 2,933,390 and 3,635,721, condensation compounds of an aromatic organic acid with formaldehyde described in U.S. Pat. No. 3,743,510, cadmium salts and azaindene compounds. Combinations of the compounds set forth in U.S. Pat. Nos. 3,615,613, 3,615,641, 3,617,295 and 3,635,721 are particularly suitable.

Although these dyes and/or super-sensitizers may be added to a silver halide photographic emulsion in a molecular form dissolved in a proper solvent, it is prefer to be added in a form of aqueous dispersion or suspension of fine solid particles. The dispersing medium for the dispersion may contains a surfactant or a water-soluble binder as a dispersing aid. The dispersion may further contains an basic compounds for increasing stability of the sensitizing dye in the dispersion.

In the silver halide photographic emulsion, various compounds may be contained for preventing fogging in the period of storage or processing, or for stabilizing the photographic properties thereof. The compounds include azoles i.e., benzothiazolium salts, nitroindazoles, nitrobenzimidazoles, chlorobenzimidazoles, bromobenzoimidazoles, mercaptothiazoles, mercaptobenzothiazoles, mercaptobenzoimidazoles, mercaptothiadiazoles, aminotriazoles, benzotriazoles, nitrobenzotriazoles, mercaptotetrazoles particularly 1-phenyl-5-mercapto-tetrazole, mercaptopyridines, mercaptotriazines, thioketo-compounds such as oxazolinethione, azaindenes particularly 4-hydroxy substituted (1,3,3a,7)tetraazaindenes, pentaazaindenes, benzenethiosulfonic acids, benzensulfinic acids, benzenesulfonamides, which are well known as fog preventing agents or stabilizers.

The light-sensitive material of the invention may contains one or more kinds of surfactants for various purposes such as for coating aid, static prevention, slipping property improvement, emulsification, adhesion prevention and for improvement in developing properties such as development acceleration, enhancing in contrast or sensitivity.

The light-sensitive material according to the invention may contain a water-soluble dye as a filter dye or anti-irradiation or anti-halation dye in a hydrophilic colloid layer thereof. Dyes preferably usable for such purpose include oxonol dyes, hemioxonol dyes, styryl dyes, merocyanine dyes, anthraquinone dyes and azo dyes. Further, cyanine dyes, azomethine dyes, triarylmethane dyes and phthalocyanine dyes are also usable. An oil-soluble dye may also be added to the hydrophilic colloid layer in a form of dispersion emulsified by an oil-in-water dispersing method. It is preferable to add a dye which is substantially insoluble in water under an acidic condition and soluble in water under an alkaline condition, to a hydrophilic colloid layer in a form of fine solid particles having an average size of not more than 0.5 μm.

The present invention can be applied for a multilayered color photographic light-sensitive material having two or more light-sensitive layers each having a spectral sensitivity different from each other. The multilayered color photographic light-sensitive material usually has at leas one red-sensitive emulsion layer, green-sensitive emulsion layer and blue-sensitive emulsion layer on a support. Arrangement order of these layers is optionally selected according to requirements. A preferable layer arrangement is that in which the red-sensitive layer, the green-sensitive layer and the blue-sensitive layer are provided on the support in this order from the support. In another arrangement of the layers, the blue-sensitive layer, the green-sensitive layer and the red-sensitive layer are provided in this order from the support. Any layer having a specific spectral sensitivity may be composed by two or more layers for obtaining a high sensitivity, and may be composed by three layers for further improving granularity thereof. A non-light-sensitive layer may be provided between two or more emulsion layers each having the same spectral sensitivity. A structure may be allowed in which an emulsion layer is provided between two emulsion layers having spectral sensitivity different from that of the above emulsion layer. For enhancing sensitivity of the light-sensitive material, a reflective layer such as a layer comprising fine silver halide grains, may be provided under a high speed emulsion layer, particularly a high speed blue-sensitive emulsion layer. Although cyan, magenta and yellow dye-forming couplers are commonly contained in the red-sensitive emulsion layer, green-sensitive emulsion layer and blue-sensitive emulsion layers, respectively, other combination may be used according to circumstance. For example, an infrared-sensitive layer may be combined for false color photography or recording semiconductor laser exposure.

In the light-sensitive material of the invention, a silver halide photographic emulsion and/or an other layer are coated on a elastic support usually used for a support of light-sensitive material such as a plastic film, paper of cloth or on a rigid support such as glass, seramics or metal. Suitably usable elastic supports include a film composed of semi-synthetic or synthetic high-molecular substance such as cellulose nitrate, cellulose acetate, cellulose acetopropionate, polyethylene terephthalate or polycarbonate; and a paper which is coated or laminated with a baryta layer or a layer of α-olefin polymer such as polyethylene, polypropylene or copolymer of ethylene and butene. These supports may be tinted with a dye or a pigment. Further, the support may be blackened for light shielding. The surface of the support is usually subjected to a subbing treatment for improving adhesion of it with a photographic emulsion layer. The surface of the support may be treated with glow discharge, corona discharge, ultraviolet irradiation or flame treatment before or after the subbing.

A silver halide emulsion layer and/or another hydrophilic colloid layer can be coated by well-known various coating methods, for example, a dip-coating method, roller-coating method, curtain-coating method and extruder-coating method. The layers may be coated simultaneously by a coating method each described in U.S. Pat. Nos. 2,681,294, 2,761,791, 3,526,528 or 3,508,947.

The present invention can be applied to various kinds of color and black-and-white photographic light-sensitive materials including, for typical examples, color negative films for usual photography and cinematography, color reversal films for slide or TV use, color papers, color positive films, color reversal papers, diffusion transfer type color photographic materials, and thermal development type color light-sensitive materials. The invention can also be applied to black-and-white photographic materials such as X-ray photographic film using a mixture of three color couplers disclosed in Research Disclosure NO. 17123, July 1978, or a black dye forming coupler disclosed in U.S. Pat. No. 4,126,461 or BP 2,102,136. Further the invention can be applied to graphic arts films such as a lith film and a scanner film, X-ray films for medical radiography, medical fluorescent radiograph or industrial radiography, black-and-white films for usual photography, black-and-white photographic papers, micro films for common micro photography or COM, silver salt diffusion transfer type light-sensitive materials and print-out type light-sensitive materials. Light-sensitive materials according to the invention are advantageous in a processing in which the light-sensitive material is developed for considerably shorten time.

When the invention is applied to a color diffusion photographic material, the construction of the film unit the photographic material may be a peel-a-part type, an integrated type disclosed in JP Nos. 46-16356/1971 and 48-33697/1973, JP O.P.I. 50-13040/1975 and BP No. 1,330, 524 and a no-peeling type disclosed in JP O.P.I. 57-119345/1982.

Various exposure means can be used for the light-sensitive material according to the invention. Any light source emitting radiation spectrally corresponding to the spectral sensitivity of the light-sensitive material to be exposed can be used as a light source for illuminating or writing. Natural light or sun light, a tungsten lamp, halogen lamp, mercury lamp, fluorescent lamp or a flash light source such as a strobe lamp or a metal burning flash bulb are usually used. A gas-, dye- or semiconductor-laser, a light emitting diode and a plasma light source may be used for recording, which emits light within the range of wavelength region of from UV to infrared. A fluorescent plate such as a CRT or an intensifying screen, from which fluorescent light is emitted from a fluorescent substance exited by electron ray or X-ray, and a two dimensionally arranged or linear light source combined with a micro shatter array using liquid crystals (LCD) or lead zircotitanate doped with lanthanum (PLZT), may also be used as light source for exposure. Spectral distribution of light for exposing the light-sensitive material may be controlled by the use of a color filter when it is necessary.

A color developer preferably used for processing the light-sensitive material according to the invention is an alkaline solution containing an aromatic amine type color developing agent as a main component. Although aminophenol type compounds are usable as color developing agents, p-phenylenediamine compounds are preferably used. Typical examples of that include, 3-methyl-4-amino-N,N-diethylaniline, 3-methyl-4-amino-N-ethyl-N-β-hydroxylethylaniline, 3-methyl-4-amino-N-ethyl-N-β-methanesulfonamidoethyl-aniline, 3-methyl-4-amino-N-ethyl-N-β-methoxyethylaniline and sulfate, hydrochloride or p-toluenesulfonate thereof. Salts of these diamines are preferably used which are generally more stable than those in a free state.

The color developer usually contains an alkali carbonate, a pH buffer such as borates and phosphates, a development restrainer or fog inhibitor such as bromides, iodides, benzotriazoles, benzothiazoles or mercapto compounds. If necessary, the color developer may further contains a preservative such as hydroxylamines. dialkyl-hydroxylamines, hydrazines, triethanolamine, triethylene-diamine or sulfites; an organic solvent such as triethanol-amine or diethylene glycol; a development accelerator such as benzyl alcohol, polyethylene glycol quartenary ammonium salt or amines; a dye-forming coupler; a competing coupler; a nuclei forming agent such as sodium boron hydride; an auxiliary developing agent such as 1-phenyl-pyrazolidone; a thickener; a chelating agent such as aminopolycarboxylic acids, aminopolysulfonic acids, aklylsulfonic acids and phosphonocarboxylic acid; an antioxydation agent such as those described in German patent Publication (OLS) No. 2,622,950.

Any developing method other than the above-mentioned color development may be applied to the light-sensitive material according to the invention. Developing agents usable in a black-and-white developer include those of dihydroxybenzene type, 1-phenyl-pyrazolidone type and p-aminophenol type. These developing agents may be used singly or in combination such as a 1-phenyl-3-pyrazolidone type agent with a dihydroxybenzene type agent or p-aminophenol type agent with a dihydroxybenzene type agent. The light-sensitive material of the invention may further be developed with an infectious developer using hydroquinone and a sulfite ion buffer such as carbonyl-bisulfite.

The above hydroxybenzene type developing agents include, for example, hydroquinone, chlorohydroquinone, bromohydroquinone, iso-propylhydroquinone, methylhydroquinone, 2,3-dichlorohydroquinone and 2,5-dimethylhydroquinone. The 1-phenyl-3-pyrazolidone type developing agents include, for example, 1-phenyl-3-pyrazolidone, 4,4-dimethyl-1-phenyl-3-pyrazolidone, 4-hydroxymethyl-4'-methyl-1-phenyl-3-pyrazolidone and 4,4'-dihydroxymethyl-1-phenyl-3-pyrazolidone, and the p-aminophenol type agents include paraminophenol and N-methyl-p-aminophenol.

A compound giving sulfite ion such as sodium sulfite, potassium sulfite, potassium metabisulfite or sodium bisulfite may be added to the developer as a preservative, In the case of the infectious developer, an adduct of formaldehyde and sodium sulfite releasing little sulfite ion may be used.

In the developer, an alkaline agent such as potassium hydroxide, sodium hydroxide, sodium carbonate, sodium acetate, potassium tertiary phosphate, diethanolamine or triethanolamine is preferably used. The pH value of the developer is usually set up at 8.5 or more, preferably 9.5 or more.

The developer may contains an organic compound known as fog inhibitor or development restrainer. Examples of the organic compound include azoles such as benzothiazolium salts, nitroindazoles, nitrobenzoimidazoles, chlorobenzoimidazoles, bromobenzoimidazoles, mercaptothiazoles, mercaptobenzothiazoles, mercaptobenzoimidazole, mercaptothiadiazoles, aminotriazoles, nitrobenzotriazoles, mercaptotetrazoles particularly 1-phenyl-5-mercaptotetrazole; mercaptopyrimidines; mercaptotriazines; thioketo compound such as oxazolinethione; azaindenes such as triazaindenes, particularly 4-hydroxy substituted (1,3,3a,7) tetraazaindenes and pentaazaindenes; benzenethio-sulfonic acid, benzenesulfinic acid, benzenesulfonamide and sodium 2-mercaptobenzoimidazole-5-sulfonate.

The developer, may contains a polyalkylene oxide as a development restrainer. For instance, a polyethylene oxide having a molecular weight of 1,000 to 10,000 may be contained in the developer in a ratio of 0.1 g to 10 g per liter.

The developer preferably contains a water softener such as nitrotriacetic acid, ethylenediaminetetraacetic acid, triethylenetetraminehexaacetic acid or diethyleneteraminepentaacetic acid.

In the developer, a silver stain inhibitor described in JP O.P.I. 56-24347/1981, a uneven development inhibitor described in JP O.P.I. 60-212651 and a dissolving aid described JP O.P.I. 61-267759/1986 may be used.

In the developer, boric acid described in JP O.P.I. 62-186259/1987, sugars described in JP O.P.I. 60-93433/1985 such as sucrose, oximes such as acetoxime, phenols such as 5-sulfosalicylic acid or tertiary phosphates such as sodium phosphate and potassium phosphate, may be used as a buffer.

Various compounds may be added as developing accelerators in the processing solutions or the light-sensitive material of the invention. Preferable developing accelerators include amines, imidazoles, imidazolines, phosphonium compounds, hydrazines, thioeters, thiones, several mercapto compounds, mesoionic compounds and thiocyanates.

The development accelerator, which are particularly necessary for a rapid processing to be performed within a shorten time, may preferably be added into the color developer. However, the development accelerator may be added into the light-sensitive material according to kind of the compound to be added or location of the emulsion layer to be accelerated in development on the support of the light-sensitive material. Further, the development accelerator may be added to a pre-treatment bath provided prior to the developing bath.

The amino compounds suitable for the development accelerator include inorganic amines such as hydroxyl amine and organic amines. The organic amines include aliphatic amine aromatic amines, cyclic amines, aliphatic-aromatic amines, and all the primary, secondary, tertiary and quartenary amines are useful.

The photographic emulsion layers are usually subjected to a bleaching treatment after the color development. The bleaching treatment may be either performed individually or simultaneously with a fixing treatment. Further, in order to the process to be operated rapidly, a bleach-fixing process may be provided subsequent to a bleaching process. As a bleaching agent, a polyvalent metal compound such as a compound of iron (III), cobalt (II), chromium (IV) or copper (II), a peracid, a quinone compound or a nitro compound may be used. Typical examples of usable bleaching agents include ferricyanides; bichromates; organic complexes of iron (III) or cobalt (III), for example, complexes of these metal ions with an organic acid such as citric acid, tartaric acid or malic acid and those with an aminopolycarboxylic acid such as ethylenediaminetetraacetic acid, diethylenetriaminepentaacetic acid, nitrotriacetic acid or 1,3-diamino-2-propanoltetraacetic acid; persulfates; manganates; and nitrosophenol. Among the above, ferric ethylenediaminetetraacetates, ferric diethylenetriaminepentaacetates and persulfates are preferable from the viewpoint of rapid processing and environmental pollution. Further, ferric ethylenediaminetetraacetates are particularly suitable either for a bleaching bath or a bleach-fixing bath.

If necessary, a bleach accelerating agent can be used in the bleaching solution, bleach-fixing solution or a prebath solution provided prior to these processing baths. Examples of suitable bleach-accelerating agents are disclosed in the following references: i.e., compounds having a mercapto group or a disulfide group as disclosed in U.S. Pat. No. 3,893,858; West German Patent Nos. 1,290,812, 2,059,988; JP O.P.I. Nos. 53-32736/1978, 53-57831/1978, 53-65732/1978, 53-72623/1978, 53-95630/1978, 53-95631/1978, 53-104232/1978, 53-124424/1978, 53-141623/1978, 53-28426/1978 and Research Disclosure No. 17,129(July 1978); thiazolidine derivatives as disclosed in JP O.P.I. No. 50-140129/1975; thiourea derivatives as disclosed in JP No. 45-8504/1970, JP O.P.I. Nos. 52-20832/1977 and 53-32735/1978, U.S. Pat. No. 3,706,561; iodides as disclosed in West German Patent No. 1,127,715, and JP O.P.I. No. 58-16235/1983; polyethylene oxides as disclosed in West German Patent Nos. 966,410 and 2,748,430; polyamine compounds as disclosed in JP No. 45-8336/1970 and the compounds disclosed in JP O.P.I. Nos. 49-42434/1974, 49-59644/1974, 53-94927/1978, 54-35727/1979, 55-26506/1980 and 58-163940/1983; and an iodide ion and a bromide ion can also be used. Among these compounds the compounds having a mercapto group or a disulfide group are preferable in view of large acceleration effect and, particularly, compounds disclosed in U.S. Pat. No. 3,893,858, West German Patent No. 1,290,812 and JP O.P.I. No. 53-95630/1978 are preferable. Further those compounds disclosed in U.S. Pat. No. 4,552,834 are also preferable. These compounds may be incorporated in the light-sensitive material. These bleach-accelerating agents are particularly advantageous for bleach-fixing color light-sensitive materials for photographing.

As for the fixing agent, thiosulfates, thiocyanates, thioether compounds, thiourea compounds and a large quantity of iodide may be used. Among them, thiosulfates are usually used. As for the preservative for the bleach-fixing solution or the fixing solution, sulfites, bisulfites or carbonyl bisulfite adducts are preferably usable. After the bleach-fixing or the fixing treatment, a washing or rinsing treatment or a stabilizing treatment is usually conducted. In the washing or the stabilizing treatment, for the purpose of preventing precipitate formation or saving water, a variety of known compounds can be used. For example, in order to prevent precipitation, a softening agent for hard water including inorganic phosphoric acids, aminopolyacetic acids, organic aminopolyphosphoric acids or an organic phosphoric acids; various kinds of anti-bacterial agent or an anti-molding agent, metal salts such as magnesium salts or aluminum salts or bismuth salts; and a surface active agent for reducing drying load or preventing uneven drying, and other hardening agents, may be added. Also, a compound disclosed on pages 344 through 359, Vol. of "Journal of Photographic Science and Engineering" written by L. E. West can be added. Especially addition of a chelating agent or an anti-mold is effective.

Washing step is usually carried out with two or more washing baths arranged in a counter-flow mode for saving water. Further, in place of the washing step, a multibath counter-flow stabilization process as described in JP O.P.I. No. 57-8543/1982 may be applied. This process usually requires two to nine counter-flow baths with multiple stage. In the stabilizing solution used in this process, various kinds of additives can be incorporated for the purpose of stabilizing an image formed. For example, various kinds pH buffers to adjust the pH of the layers of a light-sensitive material to 3 to 9 including, for example, combinations of borates, metaborates, borax, phosphates, carbonates, potassium hydroxide, sodium hydroxide, ammoniacal water, monocarboxylic acids, a dicarboxylic acids and a polycalboxylic acids, and aldehyde such as formalin can be mentioned as representative compounds. Besides the above, if necessary, a chelating agent such as an organic phosphoric acid, an aminopolycarboxylic acid, an organic phosphoric acid, an organic phosphonic acid, an aminopolyphosphonic acid, a phosphonocarboxylic acid; a germicide such as benzoisothiazolinone, isothiazolone, 4-thiazolinebenzoimidazole, a halogenized phenol, a sulfanylamide and benzotriazole; a surface active agent, a fluorescent whitening agent and a hardening agent may also be incorporated, either singly or two or more kinds in combination.

Moreover it is preferable to add various kinds of ammonium salts as a pH controlling agent for the layers of light-sensitive material after processing, such as ammonium chloride, ammonium nitrate, ammonium sulfate, ammonium phosphate, ammonium sulfite and ammonium thiosulfate.

Further in the case of a color photographic material for photographing, it is possible to replace washing through stabilizing steps, which are usually employed by the above-mentioned stabilization step and the washing step. In this case, formalin in the stabilization solution may be omitted when a two-equivalent-type magenta coupler is used in a color light-sensitive material to be processed.

The processing time for washing and stabilizing may be varied depending on the kind of light-sensitive material and conditions of processing. it is usually, however, 20 seconds to 10 minutes and, preferably 20 seconds to 5 minutes.

In the silver halide light-sensitive material according to the invention, a color developing agent may be incorporated for the purpose of simplification or shortening of the processing. It is preferable to incorporate the color developing agent in various forms of precursors thereof. For example, indoaniline-type compounds disclosed in U.S. Pat. No. 3,342,597; Schiff base-type compounds disclosed in U.S. Pat. No. 3,342,599 and Research Disclosure Nos. 14,850 and 15,159; aldol compounds as disclosed in Research Disclosure No. 13,924; metal salt complexes as disclosed in U.S. Pat. No. 3,719,492; urethane-type compounds disclosed in JP O.P.I. No. 53-135628/1978 and other various salt-type precursors disclosed in JP O.P.I. Nos. 56-6235/1981, 56-16133/1981, 56-59232/1981, 56-67842/1981, 56-83734/1981, 56-83735/1981, 56-83736/1981, 56-89735/1981, 56-81837/1981. 56-54430/1981, 56-106241/1981, 56-107236/1981, 57-97531/1982 and 57-83565/1982 can be mentioned.

Various types of 1-phenyl-3-pyrazolidone compounds may also be incorporated in the silver halide light-sensitive color photographic material of the invention, if necessary, for accelerating color development. Representative compounds are disclosed in, for example, JP O.P.I. Nos. 56-64339/1981, 57-144547/1982, 57-211147/1982, 58-50532/19830, 58-50534/1983, 58-50535/1983 and 58-115438/1983.

Processing solutions may ordinary used at a temperature ranging of 10° to 50° C., particularly 33° to 38° C. However, it is also possible to elevate the temperature in order to accelerate the processing and shorten the total processing time or, on the other hand, to lower it in order to improve the quality of the image to be produced and stability of the processing solutions. A cobalt intensifying treatment described in West Germany Patent No. 2,226,770 and U.S. Pat. No. 3,674,499 or an intensifying treatment with hydrogen peroxide may also be applied.

Each of the processing baths may be equipped with an optional attachment, if necessary, such as a heater, a temperature sensor, a liquid level-sensor, a pump for circulation, a filter, a floating lid, a squeezer.

Further, when continuous processing is conducted, constant and stable finishing may be attained by avoiding fluctuation of the compositions of the processing solution by the use of a replenishing solution. Also, the replenishing amount may be lessened by half or less to reduce cost.

When the silver halide light-sensitive photographic material according to the present invention is a color printing paper or a color photographic material for photographing, a bleaching process may be performed, if necessary.

When the light-sensitive material according to the invention is one for black-and-white photography, the processing time is usually shorter than ten minutes, though the time may be varied according to the kind of the light-sensitive material, processing conditions. Preferably, a rapid processing, in which the processing time is shorter than 45 seconds may be employed. More preferably, a processing in which developing time is less than 30 seconds is applied.

In the above, the processing time denotes the period between when the front end of the light-sensitive material is put into the developing solution and when it comes out of the final drying zone of an automatic processing machine.

As for the method of expediting the drying time in the automatic processing machine, for example, a method of drying while reducing humidity in the drying zone as disclosed in JP O.P.I. No. 1-260444/1989; a method of drying while irradiating far infra-red rays or microwave as disclosed in JP O.P.I. No. 1-260444/1989 and a method of using heated transfer rollers as disclosed in JP O.P.I. No. 1-260448/1989 are known.

EXAMPLES

Example 1

(Preparation of solid particle dispersion of selenium compound)

In 30 kg of ethyl acetate, the following selenium compound, triphenylphosphine selenide, was added and stirred for completely dissolving the compound.

On the other hand, 8.3 kg of gelatin for photographic use was dissolved in 38 kg of pure water, and 93 g of a 25 weight percent solution of the following surfactant was added to the solution. Then the above two solutions were mixed and subjected to liquid/liquid dispersion at 50° C. for 30 minutes by a high-speed stirring type dispersing machine having a dissolver with a diameter of 10 cm. In the dispersion process the circumferential blade speed for dispersion was set up at 5 m/sec. A pressure reducing operation was started immediately after the dispersing process. Ethyl acetate was removed by stirring under reduced pressure until the remaining concentration of ethyl acetate was reduced to 0.3% by weight. After that, the solution was diluted by pure water to 80 kg in total. Further four kinds of dispersions were prepared in the same manner as above except that the circumferential blade speed in the dispersing process were set up at, 8, 12, 20 and 40 m/sec., respectively.

(Measurement of the diameter of solid particles of the selenium compound in the dispersion)

The diameter of solid particles of the selenium compound in the above-obtained four kinds of dispersions were determined by a photon correlation spectroscopic method. Thus, results listed in Table 1 were obtained.

(Test for standing stability of the solid particles dispersion of selenium compound)

A part of each of the above-obtained five kinds of dispersions was sampled and stand for one hour at 50° C. without stirring. The diameter of the particles after the standing were measured in the above-mentioned method. Results are shown in Table 1 also.

Selenium compound

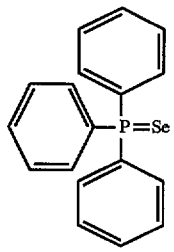

Surfactant

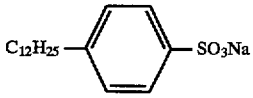

TABLE 1

| | Comparative sample | | Inventive sample | | |
|---|---|---|---|---|---|
| Circumferential blade speed (m/sec.) | 5.0 | 8.0 | 12 | 20 | 40 |
| Particle diameter after dispersion (μm) | >5 | 3.8 | 2.9 | 2.0 | 1.7 |
| Particle diameter after standing (μm) | Depot. | Depot. | 3.2 | 2.1 | 1.7 |

Deopt.: Particles were deposited.

The results of Table 1 prove that the diameter of particles of the selenium compound can be controlled by the circumferential bald speed at the time of liquid/liquid dispersion. Further, it is confirmed that a selenium compound dispersion excellent in the stability can be obtained by controlling the diameter of the solid dispersion particles of the selenium compound in the dispersion to not more than 3 μm. The variation in the particle diameter during standing is little in such dispersion.

Example 2

(Preparation of a solid particle dispersion of selenium compound)

An ethyl acetate solution of the above selenium compound was prepared in the same manner as in Example 1. On the other hand, In 38 kg of pure water, 2.0 kg of polyvinylpyrrolidone was dissolved and 93 g of a 25% by weight solution of surfactant the same as in Example 1 was added. The two kinds of solutions were mixed and subjected to liquid/liquid dispersion at 50° C. by the same equipment as in Example 1 with a circumferential blade speed of 30 m/sec for 30 minutes. Then the solid particle dispersion of selenium compound was finished to 80 kg in the same manner as in Example 1.

The particle diameter of the above-obtained solid particle dispersion of selenium compound was 1.8 μm, which was measured by the method the same as in example 1.

(Test for standing stability of the solid particles dispersion of selenium compound)

The standing stability of the solid particle dispersion was measured by the same manner as in Example 1. No variation in the particle diameter was observed under such standing condition.

It was confirmed that a selenium compound dispersion which is small in the variation of particle diameter and is excellent in the standing stability similar to that in Example 1 can also be obtained when polyvinylpyrrolidone is used as a water-soluble binder.

Example 3

| (Preparation of seed emulsion-1) | |
|---|---|
| A1 | |
| Ossein gelatin | 24.2 g |
| Water | 9,657 ml |
| Sodium polypropyleneoxy-polyethyleneoxy-disuccinate (10% ethanol solution) | 6.78 ml |
| Potassium bromide | 10.8 g |
| 10% nitric acid | 114 ml |
| B1 | |
| 2.5 N aqueous solution of silver nitrate | 2,825 ml |
| C1 | |
| Potassium bromide | 824 g |
| potassium iodide | 23.5 g |
| Water | make to 2,825 ml |
| D1 | |
| 1.75N aqueous solution of Potassium bromide | |
| An amount necessary controlling silver electrode potential | |

To Solution A1, 464.3 ml of Solutions B1 and the same amount of Solution C1 were simultaneously added spending 1.5 minutes while stirring by a mixing stirring machine described in JP Nos. 58-58288/1983 and 58-58289/1983 for forming nuclei.

After the supplying of Solutions B1 and C1 was stopped, the temperature of Solution A1 was raised to 60° C. spending 60 minutes and pH value of the solution is adjusted to 5.0 using a 3% potassium hydroxide solution. After that, Solution B1 and C1 were further simultaneously added for 42 minutes with a flow rate of 55.4 ml/min. The silver electrode potential of the solution in during the period of temperature raising from 35° C. to 60° C. and the period of simultaneously mixing Solution B1 and C1 were controlled with Solution D1 so as to maintained at +8 mV and +16 mV, respectively. The silver electrode potential was measured by using a saturated calomel-silver chloride electrode and a silver ion-selective electrode.

After addition of the solutions, pH value of the mixed solution was adjusted to 6 and the mixed solution was consequently desalted and washed. It was confirmed that, in the above-obtained Seed Emulsion-1, the projection area of hexagonal tabular grains having a maximum adjacent edge ratio of 1.0 to 2.0 occupied 90% or more of the total projection area of the whole grains of the emulsion, and the average thickness and the average diameter in terms of circular diameter equivalent to the projection area of the hexagonal tabular grains were 0.06 μm and 0.59 μm, respectively. The variation coefficient of the thickness and the distance between twin surface were 40% and 42%, respectively.

(Preparation of Emulsion 1)

An emulsion comprising tabular grains having each having a core/shell structure was prepared using the above-mentioned Seed Emulsion-1 and the following five kinds of solutions.

| | |
|---|---|
| A2 | |
| Ossein gelatin | 11.7 g |
| Sodium polypropyleneoxy-polyethyleneoxy-disuccinate (10% ethanol solution) | 1.4 ml |
| Seed Emulsion-1 | Corresponding to 0.1 mole |
| B2 | |
| Ossein gelatin | 5.9 g |
| Potassium bromide | 6.2 g |
| Potassium iodide | 0.8 g |
| Water | make to 145 ml |
| C2 | |
| Silver nitrate | 10.1 g |
| Water | make to 145 ml |
| D2 | |
| Ossein gelatin | 6.1 g |
| Water | make to 304 ml |
| E2 | |
| Silver nitrate | 137 g |
| Water | make to 304 ml |

Solutions B2 and C2 were simultaneously added spending 58 minutes to Solution A2 while vigorously stirring at 67° C. Then Solutions D2 and E2 were simultaneously added to the above solution for 48 minutes. Values of pH and pAg were maintained during the above-mentioned period at 5.8 and 5.5, respectively. Thus obtained emulsion was desalted and washed in the same manner as in Seed Emulsion-1 after completion of addition of the solutions.

The sensitizing effect of the solid particle dispersion of selenium compound of the invention was measured using the above Emulsion-1 as follows.

A solid particle dispersion of Spectral Sensitizing Dyes 1 and 2 prepared in the following manner was added to the emulsion at 60° C. After that, an aqueous solution of mixture of ammonium thiocyanate, gold chloride and sodium thiosulfate and the solid particle dispersion of selenium compound prepared in Example 1 with a circumferential blade speed of 40 m/sec. were added to the emulsion. The emulsion was chemically ripened for 2 hours in total. Fine particles of silver iodide were added at a time after 60 minutes from the start of the chemical ripening. As a stabilizer, 4-hydroxy-6-methyl-1,3,3a,7-tetraazaindene (TAI) was added to the emulsion at the time of completion of the chemical ripening. The added amounts of the addenda per mole of silver halide were given below.

| | |
|---|---|
| Potassium thiocyanate | 95 mg |
| Gold chloride | 2.5 mg |
| Sodium thiosulfate | 2.0 mg |
| Solid particle dispersion of selenium compound | 267 mg |
| Spectral sensitizing dye 1 | |

-continued

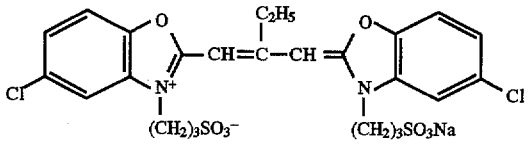

Spectral sensitizing dye 2

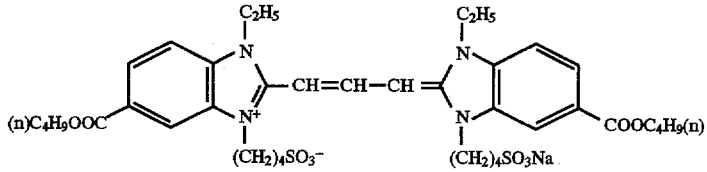

Fine particle silver iodide emulsion: An amount necessary for making the average iodide content to 4 mol % at the outermost surface portion of the grains of Emulsion-1.

4-hydroxy-6-methyl-1,3,3a,7-tetraazaindene 280 mg (Preparation of the solid particle dispersion of spectral sensitizing dyes)

The solid particle dispersion of spectral sensitizing dyes was prepared by the method in which Spectral Sensitizing Dyes 1 and 2 were added to water maintained at 40° C. and dispersed by a high-speed stirring dispersing machine having a dissolver of 100 mm diameter with a stirring speed of 1,500 rpm, dispersing time was 30 to 120 minutes according to the volume of the dispersion.

(Preparation of coating solution)

The following addenda were added to thus chemically sensitized emulsion to prepare a coating solution. On the other hand, a coating solution for protective layer was prepared. The coating solutions were simultaneously coated on both side of a support by two slide hopper type coater so that the coating amounts of silver and gelatin per one side of the support to be 2.0 g/m$^2$ and 3.1 g/m$^2$, respectively. The coatings were dried to prepare Sample 1.

Sample 2 was prepared in the same manner as in Sample 1 except that the solid particle dispersion of selenium compound was replaced by that prepared in Example 2. Further, Sample 3 was prepared, for comparing with Samples 1 and 2, in the same manner as in Sample 1 except that a solution of the above-mentioned selenium compound in a mixture solvent of ethyl acetate and methanol was used in an amount of the selenium compound of 0.4 mg per mole of silver in place of the dispersion of solid particles of selenium compound.

As the support, a blue tinted polyethylene terephthalate film base for X-ray film was used, which had a thickness of 175 μm and an optical density of 0.15. On both sides of the support, a subbing solution was coated. The subbing solution was composed of an aqueous dispersion containing 10% by weight of a copolymer of 50% by weight of glycine dimethacrylate, 10% by weight of methyl acrylate and 40% by weight of butyl methacrylate, and a filter dye and gelatin each dispersed in the copolymer dispersion. The coating amounts of the filter dye and gelatin were 20 mg/m$^2$ and 0.4 g/m$^2$, respectively. The addenda which were added to the silver halide photographic emulsion were as follows. The amount of them are set forth in terms of those per mole of silver halide.

| | |
|---|---|
| 1,1-Dimethylol-1-bromo-1-nitromethane | 2.0 mg |
| t-Butylcatechol | 400 mg |
| Polyvinylpyrrolidone | 1.0 g |
| Styrene/maleic anhydride copolymer | 2.5 g |
| Nitrophenyl-triphenyl-sulfonium chloride | 50 mg |
| Ammonium 1,3-dihydroxybenzene-4-sulfonate | 2.0 g |
| $C_4H_9OCH_2CH(OH)CH_2N(CH_2COOH)_2$ | 1.0 g |
| 1-Phenyl-5-mercaptotetrazole | 15 mg |
| Compound 6 | 150 mg |
| Compound 7 | 70 mg |
| Potassium chloroparadate (II) | 15 mg |
| Filter dye | |

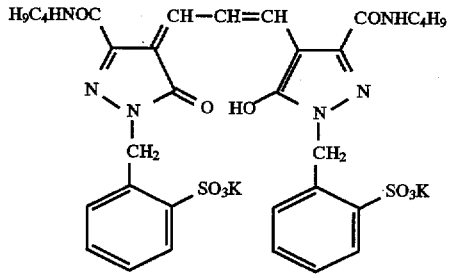

Compound 6

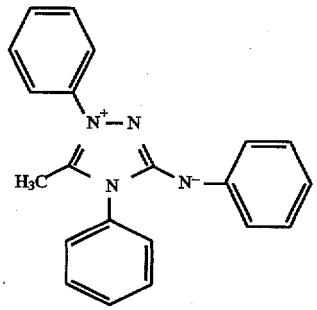

Compound 7

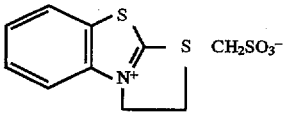

The coating solution for protective layer were prepared as follows. The amounts of addenda are described in terms of those per 1 liter of the coating solution.

| | |
|---|---|
| Lime-processed inert gelatin | 68 g |
| Acid-processed gelatin | 2.0 g |
| Sodium i-amyl-n-decylsulfosuccinate | 1.0 g |
| Polymethylmethacrylate (matting agent having an average particle size of 3.5 μm) | 1.1 g |
| Silicon dioxide particles (matting agent having an average particle size of 3.5 μm) | 0.5 g |
| $(CH_2{=}CHSO_2CH_2)_2$ (hardener) | 500 mg |
| $C_4F_9SO_3K$ | 2.0 mg |
| $C_{12}H_{25}CONH(CH_2CH_2O)_5H$ | 2.0 g |
| Compound 8 | 1.0 g |
| Compound 9 | 0.4 g |
| Compound 10 | 0.1 g |

The photographic properties of thus obtained Samples 1 to 3 were evaluated after standing for 4 days at 23° C. and 55% RH.

The evaluation was carried out as follows. Each sample was set between two sheets of intensifying screen, manufactured by Konica Corporation, and exposed through an aluminum wedge to X-ray generated by a bulb potential of 80 kvp, a bulb current of 100 mA for 0.05 sec. The exposed sample was processed by the following developer and fixer in an automatic processor SRX-502 product of Konica corporation.

| Receipt of developer | |
|---|---|
| Part A for 12 l of finished developer | |
| Potassium hydroxide | 450 g |
| Potassium sulfite (50% solution) | 2,280 g |
| Diethylenetriaminepentaacetic acid | 120 g |
| Sodium hydrogen carbonate | 132 g |
| 5-methylbenzotirazole | 1.2 g |
| 1-Phenyl-5-mercaptotetrazole | 0.2 g |
| Hydroquinone | 340 g |
| Water | make to 5,000 ml |
| Part B for 12 l of finished developer | |
| Glacial acetic acid | 170 g |
| Triethylene glycol | 185 g |
| 1-Phenyl-3-pyrazolidone | 22 g |
| 5-Nitroindazole | 0.4 g |
| Starter | |
| Glacial acetic acid | 120 g |
| Potassium bromide | 225 g |

| Receipt of Fixer | |
|---|---|
| Part A for 18 l of fixer | |
| Ammonium thiosulfate (70 w/v %) | 6,000 g |
| Sodium sulfite | 110 g |
| Sodium acetate trihydrate | 450 g |
| Sodium citrate | 50 g |
| Gluconic acid | 70 g |
| 1-(N,N-dimethylamino)-ethyl-5-mercaptotetrazole | 18 g |
| Part B for 18 l of fixer | |
| Aluminum sulfate | 800 g |

To prepare a developer, Parts A and B were simultaneously added to 5 l of water and water further added while stirring to make up the solution to 12 l, and the pH value of the solution was adjusted to 10.40 by glacial acetic acid. A developer to be used was prepared by adding Starter to the above-prepared developer in a ratio of 20 ml/l and adjusting pH to 10.26.

To prepare a fixer, Parts A and B were simultaneously added to 5 l of water and the mixture was made up to 18 l by water, and the pH value of the solution was adjusted to 4.4 sulfuric acid or sodium hydroxide. The solution was used as fixer replenisher. The processing temperature was 35° C. for developing, 33° C. for fixing, 20° C. for washing and 50° C. for drying. Processing time was 45 seconds for dry to dry.

Sensitivity and fog were measured. The sensitivity is expressed by a reciprocity of exposure amount necessary for forming a density of 0.5 on fog density, and the sensitivity of the samples are described in terms of relative value when that of Sample 3, which is exposed and processed after standing for 4 days at 23° C. and 55% RH, is set as 100. Thus obtained results are shown in Table 2.

Compound 8

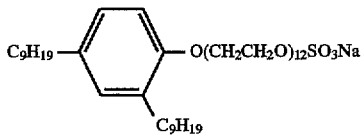

Compound 9

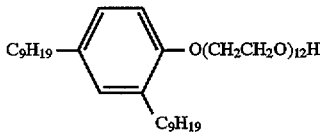

Compound 10

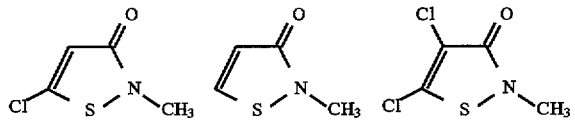

(50:46:4)

TABLE 2

| Sample | Sensitivity | Fog |
|---|---|---|
| No, 1 (Inventive) | 127 | 0.007 |
| No. 2 (Inventive) | 129 | 0.008 |
| No. 3 (Comparative) | 100 | 0.010 |

It is confirmed from the results shown in Table 2 that chemical sensitization giving a high sensitivity with lowered fogging can be performed by the method of the invention and that a silver halide photographic light-sensitive material having a high sensitivity and low fog can be prepared.

Example 4

To 30 kg of ethyl acetate, 30 g of N,N-dimethylselenourea was added and stirred at 50° C. to be completely dissolved. On the other hand 3.8 kg of photographic gelatin was dissolved in 38 kg of pure water, and On the other hand, 8.3 kg of gelatin for photographic use is dissolved in 38 kg of pure water, and 39 g of a 25 weight percent solution of the above-mentioned surfactant is added to the solution. Then the above two solutions are mixed and subjected to liquid/liquid dispersion at 50° C. for 30 minutes by a high-speed stirring type dispersing machine having a dissolver with a diameter of 10 cm. In the dispersion process, the circumferential blade speed for dispersion was set up at 8 m/sec. A pressure reducing operation was started immediately after the dispersing process. Ethyl acetate was removing by stirring under the reduced pressure until the remaining concentration of ethyl acetate was become 0.3% by weight. After that, the solution was diluted by pure water to 80 kg in total. Further two kinds of dispersions were prepared in the same manner as above except that the circumferential blade speed in the dispersing process was set at, 15 and 45 m/sec., respectively. The above-obtained three kinds of dispersions were numbered each 11, 12 and 13, respectively.

Example 5

A ethyl acetate solution of N,N-dimethylselenourea was prepared in the same manner as in Example 4. On the other hand, 2.0 kg of polyvinylpyrrolidone was dissolved in 38 kg of pure water. Then the above two solutions are mixed and subjected to liquid/liquid dispersion at 40° C. for 30 minutes by the same dispersing machine as in Example 4. The circumferential blade speed of the dissolver was set up at 18 m/sec. Thus obtained dispersion was treated in the same manner as in Example 4 to prepare a 80 kg of dispersion containg solid dispersed particles of N,N-dimethylselenourea. Further, a dispersion was prepared in the same manner as above except that the circumferential blade speed of the dissolver was set up at 35 m/sec. Thus two kinds of dispersions numbered 14 and 15 were prepared.

Example 6

Sample 5 through 9 of light-sensitive materials were prepared and evaluated in the same manner as in Example 3 except that the above dispersions 11 through 15 were each used as selenium sensitizer, respectively. Further Sample 4 was prepared in which N,N-dimethylselenothiourea was used in a form of an alcoholic solution. In the above samples, the amount of selenium compound added was 0.6 mg per mol of silver halide.

In Table 3, the circumferential blade speed of the dissolver, particle size of selenium compound and photographic properties of the samples are listed.

TABLE III

| Sample | Selenium dispersion | | | Photographic property | |
|---|---|---|---|---|---|
| | | C.B.S. | Particle size | | |
| No. | No. | (m/sec) | (μm) | Sensitivity | Fog |
| 4 | | Alcoholic solution | | 100 | 0.035 |
| 5 | 11 | 8 | >5 | 98 | 0.018 |
| 6 | 12 | 15 | 2 | 106 | 0.010 |
| 7 | 13 | 45 | 0.7 | 108 | 0.015 |
| 8 | 14 | 18 | 1.6 | 107 | 0.012 |
| 9 | 15 | 35 | 0.9 | 109 | 0.016 |

As is shown in Table 3, the effect of the selenium compound is depended on the dispersed particle size of the compound. Decreasing in the particle size of the selenium compound causes a increasing in the sensitivity and slightly increasing in fogging of the light-sensitive material. Of cause, the sensitizing effect of the selenium compound is lowered when the particle size is too large as is shown in Sample 4. This facts demonstrate that the supplying rate of the selenium compound to silver halide grains can be optimized by controlling the dissolving rate of the compound from the dispersed particle. The dissolving rate of the particle is depended on the size or relative surface area of the particle.

What is claimed is:

1. A method for chemically sensitizing a silver halide photographic emulsion comprising the steps of preparing a dispersion of solid particles of an organic selenium compound selected from the group consisting of N,N-dimethylselenourea, N,N,N'-triethylselenourea, N,N,N'-trimethyl-N'-heptafloropropylcarbonylselenourea, N,N,N'-trimethyl-N'-nitrophenylcarbonylselenourea, tri-p-triselenophosphate, diethyl selenide, diethyl diselenide, pentafluorohexyldiphenylphosphine selenide and triphenylphosphine selenide, in an aqueous medium by a process comprising the following steps of (1) dissolving said organic selenium compound in a low-boiling organic solvent having a solubility of not more than 10 g per 100 g of water and a boiling point of not more than 100° C., to prepare a selenium compound solution, (2) dispersing said selenium compound solution in water or an aqueous solution of a dispersing aid to form a liquid-liquid dispersion of solvent in water, said dispersing comprising stirring a mixture of said selenium compound solution and water or said aqueous solution of a dispersing aid by a high speed stirring device having a dispersing blade with a circumferential speed of 10 m/sec to 50 m/sec, and (3) removing said organic solvent from said liquid-liquid dispersion by stirring the dispersion under a reduced pressure, to precipitate said selenium compound so as to form a dispersion of fine solid particles of said selenium compound having an average particle size of 10 nm to 3 μm in terms of circular diameter equivalent to projection area thereof;

(4) adding said dispersion of fine solid particles of said selenium compound to a silver halide emulsion, and (5) ripening said silver halide emulsion in the presence of said dispersion of fine solid particles of said selenium compound.

2. The method of claim 1, wherein the selenium compound solution is dispersed in an aqueous solution of a dispersing aid, and said dispersing aid is a surface active agent or a binder.

3. The method of claim 1, wherein said step of removing the organic solvent from said liquid-liquid dispersion by stirring under reduced pressure comprising stirring with a high speed stirring device having a dispersing blade with a circumferential blade speed of 10 m/sec to 50 m/sec.

4. The method of claim 3, wherein the amount of said selenium compound to be added to said silver halide emulsion is $10^{-8}$ moles to $10^{-4}$ moles per mol of silver contained in said silver halide emulsion; and said low-boiling organic solvent is ethyl acetate, n-hexane, n-pentane, benzene, cyclohexane, cyclopentane, chloroform or dichloromethane; and wherein said step of removing the solvent by stirring under reduced pressure comprises removing said organic solvent from said dispersion until the remaining amount of said solvent is 1% or less by weight of the total amount of the solvent used in said dispersion.

5. The method of claim 4, wherein said selenium compound is triphenylphosphine selenide.

6. The method of claim 1, wherein said organic solvent is removed from said dispersion at said step of removing organic solvent until the remaining amount of said solvent is 1% or less by weight of the total amount of the solvent used in said dispersion.

7. The method of claim 6, wherein said organic solvent has a boiling point of from 30° C. to 85° C.

8. The method of claim 6, wherein said low-boiling organic solvent is ethyl acetate, n-hexane, n-pentane, benzene, cyclohexane, cyclopentane, chloroform or dichloromethane.

9. The method of claim 1, wherein said selenium compound is triphenylphosphine selenide.

10. The method of claim 1, wherein the amount of said selenium compound to be added to said silver halide emulsion is $10^{-8}$ moles to $10^{-4}$ moles per mol of silver contained in said silver halide emulsion.

11. The method of claim 1, wherein said organic solvent has a boiling point of from 30° C. to 85° C.

12. The method of claim 1, wherein said low-boiling organic solvent is ethyl acetate, n-hexane, n-pentane, benzene, cyclohexane, cyclopentane, chloroform or dichloromethane.

* * * * *